US005415341A

United States Patent [19]

Diamond

[11] Patent Number: 5,415,341

[45] Date of Patent: May 16, 1995

[54] BUSINESS ENVELOPE

[75] Inventor: Elliott H. Diamond, Reston, Va.

[73] Assignee: Diamond Gamma, L.L.C., Reston, Va.

[21] Appl. No.: 181,966

[22] Filed: Jan. 18, 1994

Related U.S. Application Data

[63] Continuation of Ser. No. 886,093, May 21, 1992, abandoned.

[51] Int. Cl.[6] ..... B65D 27/12

[52] U.S. Cl. ..... 229/80; 229/302; 229/305; 229/306

[58] Field of Search ..... 229/302, 306, 305

[56] References Cited

U.S. PATENT DOCUMENTS

| | | | |
|---|---|---|---|
| 886,449 | 5/1908 | West | 229/305 |
| 1,091,172 | 3/1914 | Thayer | 229/302 |
| 1,575,769 | 3/1926 | Kaye | 229/306 X |
| 2,153,504 | 4/1939 | Didier . | |
| 2,317,335 | 4/1943 | Whitman | 229/305 |
| 2,350,100 | 5/1944 | Deutschmeister et al. . | |
| 2,686,005 | 8/1954 | Hyman . | |
| 2,907,514 | 10/1959 | Bermingham, Jr. et al. . | |
| 3,227,360 | 1/1966 | Krueger . | |
| 3,270,948 | 9/1966 | Donovan | 229/302 |
| 3,356,285 | 12/1967 | Greason . | |
| 3,693,869 | 9/1972 | Eaves, Jr. | 229/302 |
| 3,791,572 | 2/1974 | Gendron . | |
| 3,802,618 | 4/1974 | Wiessner . | |
| 4,278,199 | 7/1981 | Tanaka . | |
| 4,288,028 | 9/1980 | Diaz | 229/302 |
| 4,308,987 | 1/1982 | Solomon | 229/302 |
| 4,332,346 | 6/1982 | Kronman | 229/302 |
| 4,382,539 | 5/1983 | Kronman | 229/302 |
| 4,445,635 | 5/1984 | Barr | 229/302 |
| 4,455,635 | 5/1984 | Barr . | |
| 4,565,317 | 1/1986 | Kranz | 229/302 |
| 4,730,768 | 3/1988 | Gendron | 229/302 |
| 4,778,101 | 10/1988 | Paquin . | |

FOREIGN PATENT DOCUMENTS

| | | | |
|---|---|---|---|
| 0003058 | 8/1912 | United Kingdom | 229/302 |

*Primary Examiner*—Allan N. Shoap
*Assistant Examiner*—Jes F. Pascua

[57] ABSTRACT

A one-way, multi-destination and/or multi-postage scheme mailing instrument having multiple addressor, addressee and postage fields which are alternatively covered or exposed individually or as a set through the use of moveable and removable flaps. The mailing instrument enables the user to mail the envelope to different addressees using one of two preprinted addressee information blocks on the mailing instrument and/or to have the envelope show one or another of alternative addressors. Likewise, the user can mail the envelope using preprinted Business Reply Mail postage on the mailing instrument or the envelope can be sealed so that the Business Reply Mail markings are completely covered and a blank field for affixation of a conventional postage stamp is provided thereby avoiding any Business Reply Mail charge to the addressee.

5 Claims, 13 Drawing Sheets

BUSINESS ENVELOPE

This application is a continuation of application No. 07/886,093, filed May 21, 1992, now abandoned.

BACKGROUND OF INVENTION

This invention relates to a new and useful mailing instrument that enables the user to select from a multiplicity of addressing schemes and postage schemes provided on a single mailing instrument. More specifically the mailing instrument enables the sender to select one each of the more than one addressee, addressor and postage fields provided on the mailing instrument surfaces. The sender may assemble a mailing instrument having a combination of various pre-printed or blank address and postage fields that allow the same mailing instrument to be used for more than one mailing purpose; i.e. return payment to a vender by selecting the pre-printed addressee field or use for personal mail by selecting the blank addressee field.

Currently, many companies send their customers an empty self-addressed reply envelope for the collection of money owed by the customer. A bill or statement is often sent to the customer with the reply envelope. In many cases the addressee prefers to accept timely payments at one address and late payments at another address. In a second example, a company moving its office has a need for a reply envelope that can be sent to one address before the moving date and to another address after the moving date. For conservation and ecological purposes, it would be desirable for a reply envelope to have a preprinted addressee field showing the mailing address of the company and an alternative blank addressee field. If the end user has no need to use the envelope for sending a response to the company then he/she has available an envelope for personal use. Thus conservation and ecological considerations favor the inventive mailing instrument. There is a need for a single reply envelope that provides alternative address fields for return to one or the other of two addressee address fields and that provides for selection of one or the other of two addressor address fields, which are the usual return address blocks on an envelope.

Along the same lines, some companies and many non-profit organizations also employ reply envelopes that have a printed postage field on a Business Reply Envelope (BRE). A BRE is generally sent by an individual, a company or other organizational entity in order to solicit a response, contribution or order. The BRE is often part of a mass mailing that may include a catalog for material, an order form, a request for contribution, or other correspondence. The specification for an approved BRE is given by the U.S. Postal Service. A company or entity must obtain a permit for the use of Business Reply Mail thus becoming a permit holder; the permit number appears directly under the text "BUSINESS REPLY MAIL" on the envelope. The purpose of the Business Reply Envelope is to provide a postage paid method of response for a respondee through the mail. With Business Reply Mail, the cost of the postage is paid for by the permit holder upon receipt of the mail. Entities using a business reply envelope (BRE) having printed postage thereon pay a per item postage fee substantially above the first class rate that is charged for an identical mail item bearing a conventional stamp. These entities often request that their customers save them postage fees by placing a stamp in the printed postage field. Unfortunately the placement of a stamp in the printed postage field on the BRE only reduces the postage fee charged to the entity rather than eliminating the fee charged to the entity. The BRE bearing a conventional postage stamp is treated by the Post Office as a standard business reply mail item despite the placement of a conventional stamp on the mail item; this is due to the exposure of the BRE printed postage indicia appearing on the face of the mail item which is not completely covered by the postage stamp. After the entity has received the BRE bearing a postage stamp and made full payment of the BRE postage rate, the permit holder can receive a credit for a portion of the postage amount placed on the reply envelope by the respondee; this credit is substantially less than the postage fee charged to the permit holder by the Post Office.

Thus, there is also an additional need for an envelope that could be used either as a conventional non-Business Reply Envelope or as a U.S. Postal Service approved Business Reply Envelope. This would give the sender an option to either reply with or without supplying the necessary conventional postage. In addition, the permit holder would not have to pay any postage fee should the respondee elect to apply sufficient conventional postage to the inventive envelope. Further, the permit holder will save time since he/she will not have to request a postage credit from the Post Office. Prior to the invention of the subject envelope a BRE permit holder would have to provide two envelopes: one BRE and the other a conventionally printed envelope. The respondee could then choose which to send; the other being discarded. Accordingly, there is a strong need for one reply envelope having both an indicia for BRE use and an overlying sheet or face hiding the BRE indicia. The overlying sheet or face provides a second or alternative postage field for receipt of a conventional postage stamp.

There is also a need for a single mailing instrument which fulfills the above multiple needs and enjoys simple manufacture and use. Since many self-addressed reply envelopes are mass mailed by the addressee, the costs related to the envelope's manufacture, structure and printing should be minimized.

The prior art shows no available mailing instrument that solves the above problems faced by parties using standard reply and business reply mailing instruments.

The prior art shows that there has been development of several different styles of envelopes and mailing instruments providing more than one address field and postage field. These envelopes however have been for use as two way envelopes which enable the recipient of the envelope to respond to the sender using the same envelope. The prior art envelopes generally are described as having two addressee or addressor fields; two postage fields; or some combination of the two.

A first example in the prior art shows an envelope that provides two sets of address and postage field combinations. This prior art however does not provide separate address field and postage field schemes which are selectable individually. That is, the address and postage field schemes provided in the prior art must be selected as one of two alternate sets of an addressee, addressor and postage combinations. Additionally the prior art discloses an envelope that has the disadvantage of being a different size depending upon the address and postage scheme selected by the user. Also because this prior art envelope was designed specifically for two-way use the adhesive fields used to seal the envelope for one of the address/postage field combinations is insubstantial and may not provide adequate sealing to keep the envelope from coming open during mailing.

Another example in the prior art shows an envelope that provides multiple address fields and postage fields on one envelope through an unconventional sealing arrangement. This prior art envelope provides a second postage field by tucking the closing flap inside the envelope. This closing scheme is less advantageous than the applicant's two flap scheme in as much as it may prove difficult to activate the adhesive and tuck the closing flap inside of the envelope so that the envelope is sealed properly in the prior art scheme. The tucked in arrangement of the envelope also has an unconventional look which may be unacceptable to some users. In addition the alternate addressee field on the prior art envelope cannot be utilized if the correspondence in the envelope blocks the window opening in the front of the envelope.

Still another example in the prior art shows an envelope having a removable flap for use as an advertising surface. This envelope resembles the applicants invention only in as much that it shows an envelope having a flap attached to each of the two envelope opening edges. This prior art envelope does not show a multiple addressing or postaging scheme. In addition the advertising flap does not have an adhesive surface for sealing the flap to the envelope to close it.

The above noted designs fail to meet the needs of those companies, organizations, individuals and the like who wish to employ a single reply envelope having optional addressee, addressor and postage fields. In sum, prior envelopes exhibit two-way or bi-directional capability as is evident from an examination of the structural features in the above designs. The present invention has emerged as a solution to a different problem, that of a one-way multi-destination or multi-postage scheme instrument having novel structural features.

OBJECTS OF THE INVENTION

Therefore, it is a primary objective of this invention to provide a mailing instrument which provides more than one addressee address field on the mailing instrument, such address field being selectable by the user.

Further, it is a primary objective of this invention to provide a mailing instrument which provides more than one addressor address field on the mailing instrument, such address field being selectable by the user.

Further, it is a primary objective of this invention to provide a mailing instrument which provides more than one postage field on the mailing instrument, such postage field being selectable by the user.

Specifically, it is an objective of this invention to provide a mailing instrument which provides an alternative postage field that enables the user to substitute a stamp for printed BRE postage without the Post Office registering a business reply mail postage charge against the addressee.

Further, it is an objective of this invention to facilitate the use of the above addressing and postage schemes by providing multiple alternative sealing arrangements for a single mailing instrument.

Further, it is an objective of this invention to provide multiple alternative sealing arrangements which employ removable flaps for closing the envelope and/or for the provision of alternate address and postage schemes.

Further, it is an objective of this invention to provide a mailing instrument having the above multiple addressing and postage schemes which also has a closable pocket or envelope for containing correspondence inside of the mailing instrument.

Further, it is an objective of this invention to provide a mailing instrument with the above advantages that can be constructed from a continuous sheet of material.

Further, it is an objective of this invention to provide a mailing instrument with the above advantages that can be constructed by adding one or more closure flaps onto a conventional envelope structure.

Further, it is an objective of this invention to provide a mailing instrument with the above advantages which will have a conventional look and sealing arrangement regardless of which addressing or postage scheme is selected.

BRIEF SUMMARY OF INVENTION

A preferred embodiment of the invention includes an envelope closed on three sides and open at the top. First and second closure flaps are attached to each of the top edges of the envelope. The envelope can be closed with one or the other of the closure flaps. The first closure flap is used to close the envelope in a conventional manner with the flap folded over the top opening and sealed to the back of the envelope. The second closure flap is detached from the top of the envelope when the first closure flap is used to seal the envelope. When the second closure flap is used to close the envelope it is folded forward over the top opening and the first closure flap and sealed to the front of the envelope. The second closure flap covers the addressor and postage fields on the front of the envelope.

A second embodiment of the invention is the same as the preferred embodiment with the exception that the second closure flap is substantially the same size as the front of the envelope and thereby covers the addressor, addressee and postage fields on the front of the envelope.

A third embodiment of the invention includes an envelope closed on three sides and having a closure flap at the top envelope opening. First and second fold-over flaps are attached at a side edge of the envelope. The first fold-over flap can be folded over and sealed to the front of the envelope to cover the addressor and postage fields on the front of the envelope. The second fold-over flap can also be folded over and sealed to the front of the envelope to cover the addressee field on the front of the envelope. The first and second fold-over flaps are detached from the envelope when they are not used to cover address or postage fields.

The various embodiments of the invention may be constructed of a single sheet of material. When a single sheet of material is used to construct the mailing instrument, the sheet of material is of such a shape that the body portion of the mailing instrument, the associated sealing flaps and/or fold-down or fold-over flaps are created by folding the sheet of material and sealing portions of the material to other portions of the material.

BRIEF DESCRIPTION OF DRAWINGS

Other objects and advantages of the present invention will become apparent from the following detailed description of the preferred embodiment taken in conjunction with the accompanying drawings, wherein.

DETAILED DESCRIPTION

Figure 1A:
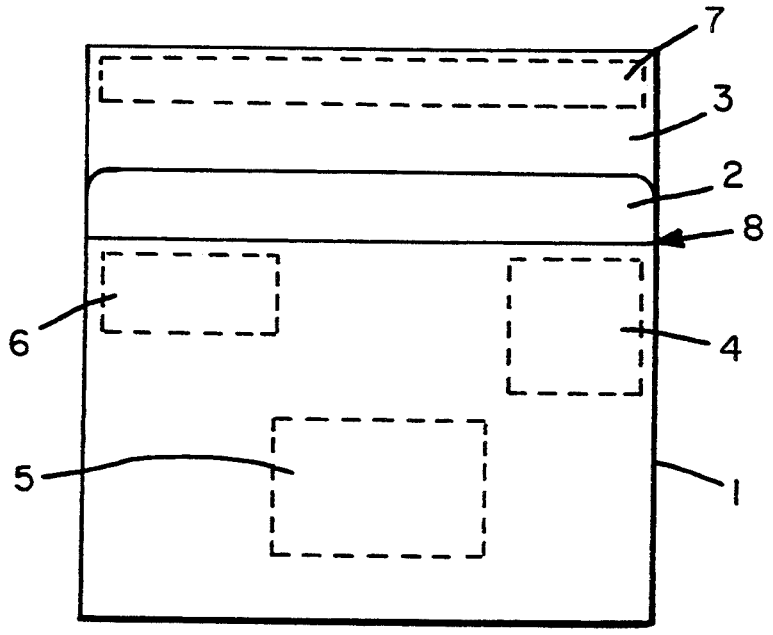
FIG. 1A is a front view of a preferred embodiment of the invention showing a mailing instrument having two closure flaps in a pre-use position, such flaps provide two distinct addressing-postaging schemes.

The mailing instrument shown in FIGS. 1A through 1D is comprised of a body portion 1, a front fold-down flap 2 and a back fold-down flap 3. In the various embodiments of the invention, the mailing instrument body 1 may be constructed of a single sheet of material whether it be paper, cardboard, plastic or some other material as is illustrated by the mailing instrument blank shown in FIG. 4A. Alternatively the mailing instrument is constructed of multiple sheets of material joined together with an adhesive or some other fastening means. In pre-use constructed form, the body 1 is closed or sealed along three of its four edges and has an opening coincident with a fold line 8 at the top edge of the mailing instrument. When the mailing instrument is in a pre-use condition a pocket for containing correspondence or other material to be mailed is created by the closure of the mailing instrument body 1 along three of its edges. The pocket formed by the body 1 is accessed from the opening at the top of the body defined at one edge by the fold line 8 which is the point where the front fold-down flap 2 is attached to the body 1 and defined at another edge by the fold line **8*a* which is the point where the back fold-down flap 3 is attached to the body 1. The fold lines 8 and 8*a* for the front fold-down flap 2 and the back fold-down flap 3** are almost coincident, being adjacent, parallel and coextensive.

Figure 4A:
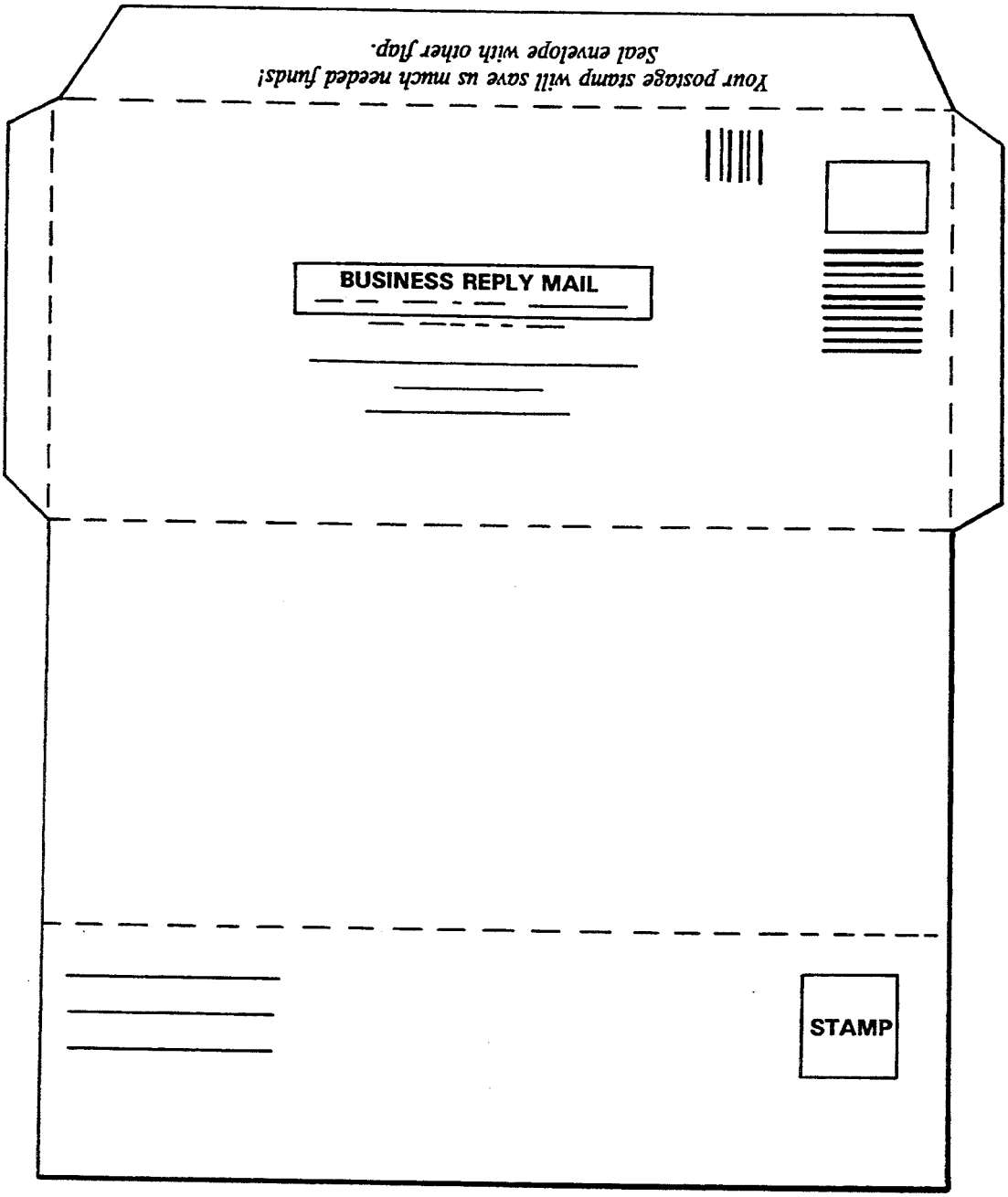
FIG. 4A is an exterior view of an unfolded blank from which a first embodiment of the mailing instrument invention can be constructed from a single sheet of material.
Figure 4B:
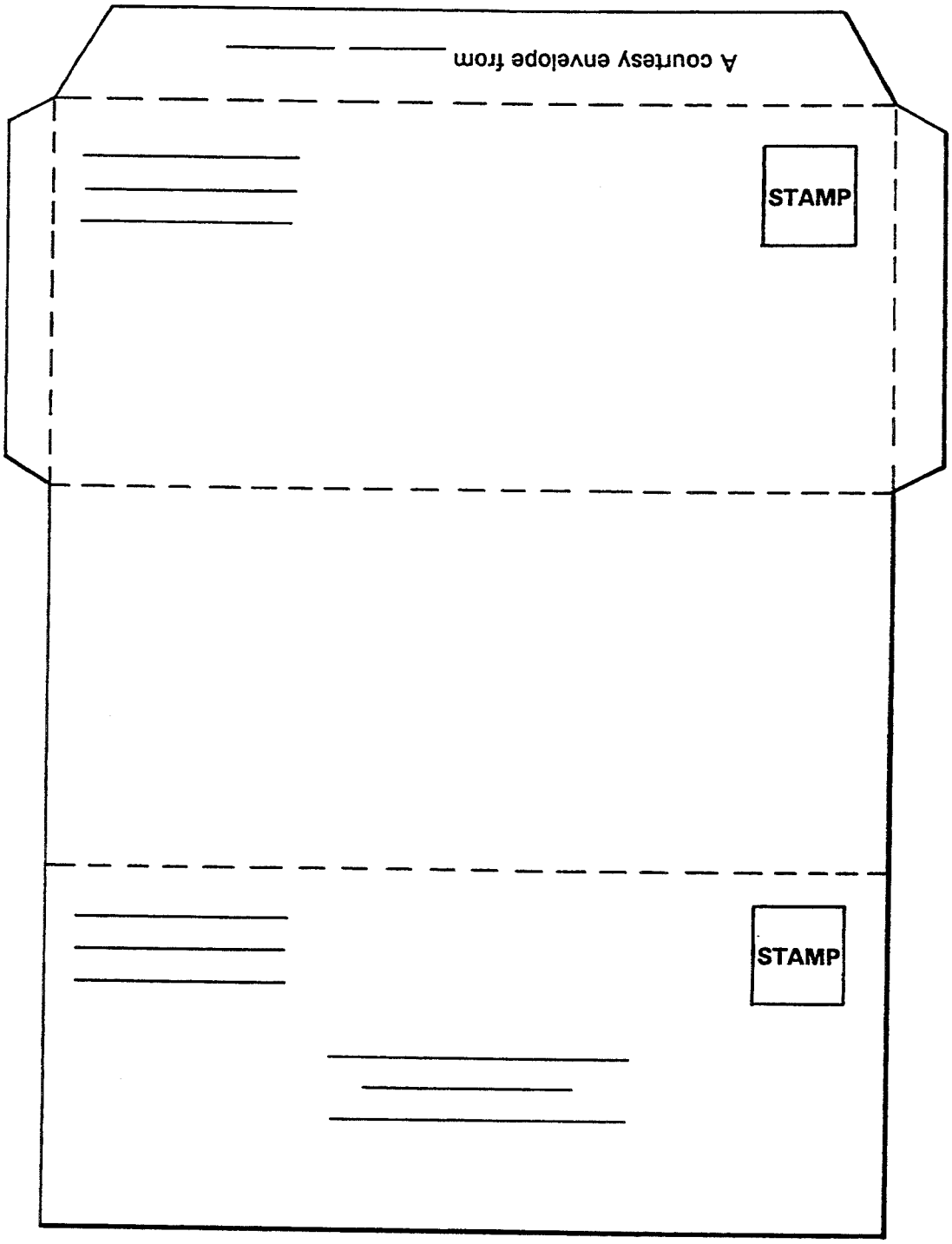
FIG. 4B is an exterior view of an unfolded blank from which a second embodiment of the mailing instrument invention can be constructed from a single sheet of material.

As previously described, in the preferred embodiment both fold-down flaps 2 and 3, and the body 1 are constructed from a single sheet of material and the attachment of the flaps 2 and 3 to the body 1 is achieved by all three components being part of a single piece of material. The shape of a blank that provides for the construction of the preferred embodiment of the invention from a single sheet of material is shown in FIG. 4A; a blank that provides for the construction of the second embodiment from a single sheet of material is shown in FIG. 4B. The blank shown in FIG. 4A includes mock addressee, addressor and postage fields. Alternatively, flap 2 or flap 3 or both flaps can be constructed from separate sheets of material which are attached to the body 1 using an adhesive hinge, a tape structure or some other attachment arrangement.

In the preferred embodiment the front of the mailing instrument body 1 includes on it a first postage field 4, a first addressee field 5 and a first addressor field 6. The same mailing instrument shown in FIG. 1C also includes on it a second (alternative) addressor field 13 and a second (alternative) postage field 11 located on the front face of the back fold-down flap 3. The two addressor/postage field schemes (fields 6 and 4, and fields 13 and 11) are provided to enable the sender to select from one of the two alternatively available addressor/-postage field schemes. Examples of possible addressor information that may be used on either the first or second addressor fields are a return address, the sender's address, the recipient's address or a blank field to be filled in by the sender. Examples of possible postage fields to be used are a BRE printed postage arrangement or a blank field for placement of a conventional postage stamp or postage meter imprint on the postage field.

Figure 1B:
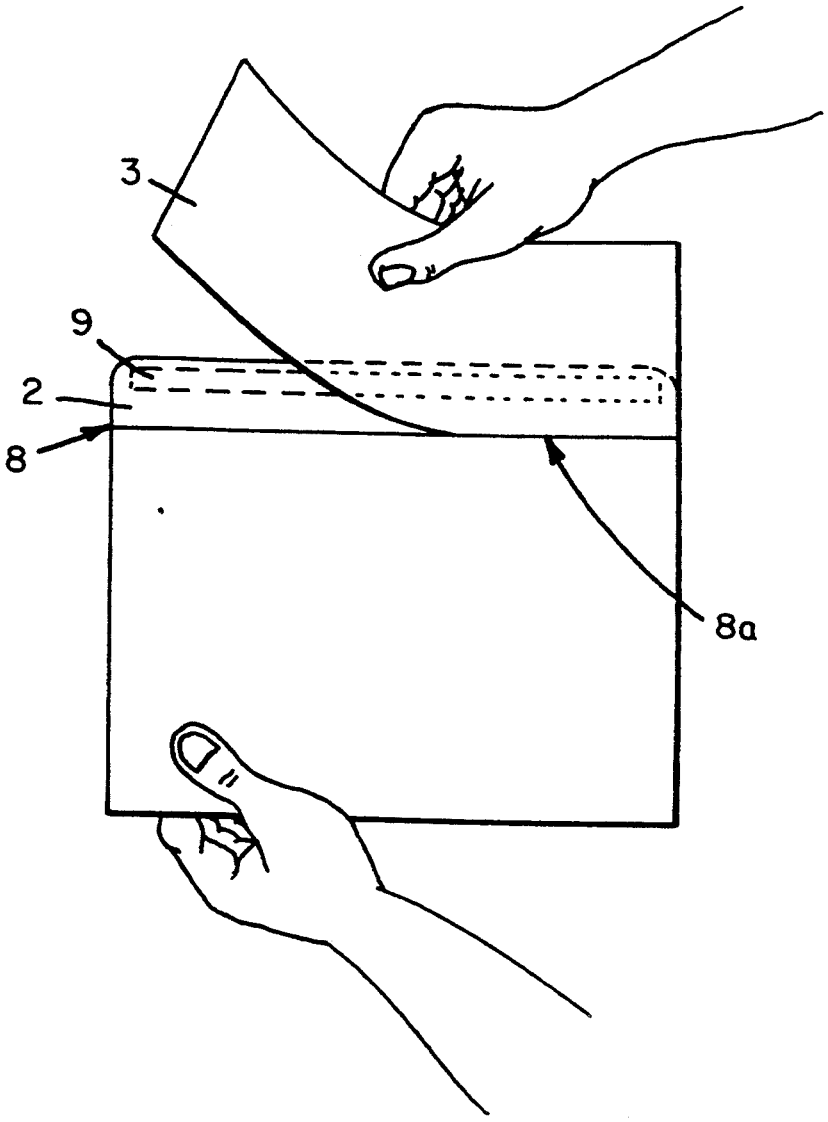
FIG. 1B is a rear view of the preferred embodiment of the invention showing the removal of one of the two closure flaps from the mailing instrument.
Figure 1C:
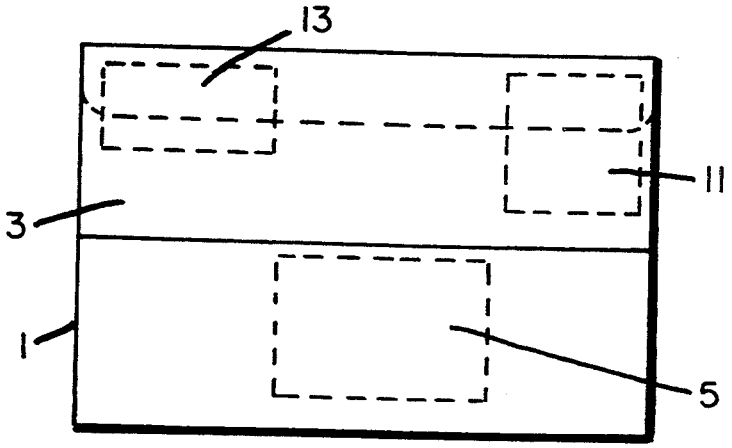
FIG. 1C is a front view of the preferred embodiment of the invention showing the mailing instrument in a sealed position using the back fold-down flap.

It is notable from drawing FIG. 1A that back fold-down flap 3 extends further from the body 1 than the front fold-down flap 2 does. The rationale for the different sizes of the flaps is evident from a description of the operation of the mailing instrument. The user of the preferred embodiment invention may use one of two alternative addressor/postage schemes depending on whether the mailing instrument is sealed using the front fold-down flap 2 or the back fold-down flap 3. If the addressor field 6 and the postage field 4 on the front face of the body 1 are selected, the user detaches the back fold-down flap 3 from the body 1 along the fold line **8*a*. Detachment of the flaps 2 and 3 may be facilitated by a perforation or by a crease or other method of weakening in the mailing instrument material created at the fold lines 8 and 8*a* between the respective flaps and the body portion 1. FIG. 1B shows the back fold-down flap 3 in a condition of partial detachment from the mailing instrument body 1. After detachment of the back fold-down flap 3, the front fold-down flap 2 is folded along fold line 8 onto the mailing instrument body 1 and is sealed to the back face of the body 1. The flap 2 is sealed with any type of adhesive material shown as 9 in FIG. 1B which is provided along the outer edge of the inside face of the flap 2, or alternatively such adhesive material can be applied to the flap 2 at the time the mailing instrument is to be used. The sealing of flap 2 to the body 1 acts to completely close the pocket formed by the body 1**.

Figure 1D:
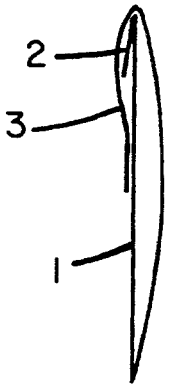
FIG. 1D is a side sectional view of the preferred embodiment of the invention showing the arrangement of the mailing instrument body and overlapping flaps when the instrument is sealed using the back fold-down flap.

If the addressor field 13 and the postage field 11 located on the back fold-down flap 3 are selected the user folds the flap 3 forward onto the mailing instrument body 1 over the flap 2 and the flap 3 is sealed to the body 1 using the adhesive, shown as 7 in FIG. 1A, provided on the outer edge of the inside face of the flap 3. Alternatively, the user may detach the flap 2 from the body portion 1 before folding the back fold-down flap 3 forward to be sealed to the body 1. The same adhesive arrangements disclosed for use with the flap 2 are to be used with the flap 3. FIG. 1D is a side sectional view of the mailing instrument showing the position of the flaps 2 and 3 when the back fold-down flap 3 is sealed to the body 1. While shown on only a single outer edge of the flaps, the adhesive areas can be made to extend along all of the edges or even all over the inside face of the flaps.

The sealing arrangement utilizing the front fold-down flap 2 is used when the sender selects the address and postage fields located on the front of the mailing instrument body 1. The front of the mailing instrument body 1 may have approved BRE printed postage and address information on it. The alternative sealing arrangement utilizing the back fold-down flap 3 is used when the sender selects the addressor and postage fields located on the back fold-down flap 3. The back fold-down flap 3 may be of a sufficient size to cover all the business reply postage printing contained on the front the mailing instrument body 1 without covering the addressee information on the front of the body 1. When back fold-down flap 3 is of such a size the sender can seal the envelope using the back fold-down flap 3 and place a postage stamp on the outer face of back fold-down flap 3 on the second postage field 11. The mailing instrument can then be sent in the mail to the addressee without the addressee being charged for the use of a business reply mail item because all indications of a BRE are covered by the back fold-down flap 3.

Figure 2A:
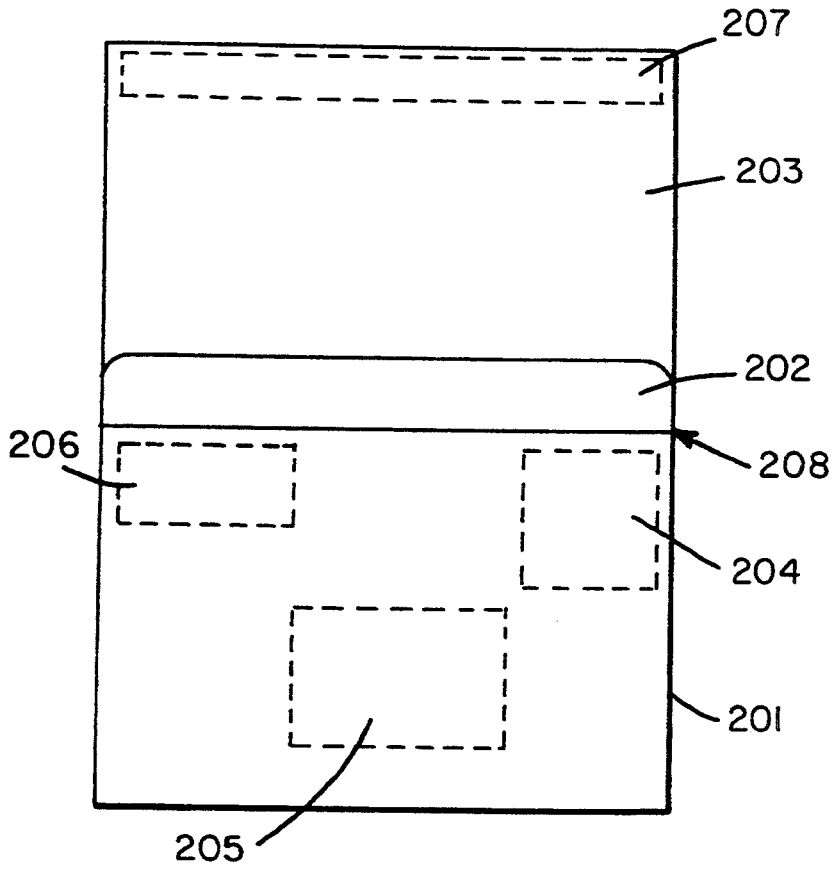
FIG. 2A is a front view of an alternative embodiment of the invention showing the mailing instrument having two closure flaps in a pre-use position, where the back fold-down flap is of a size to cover the entire front of the envelope.
Figure 2B:
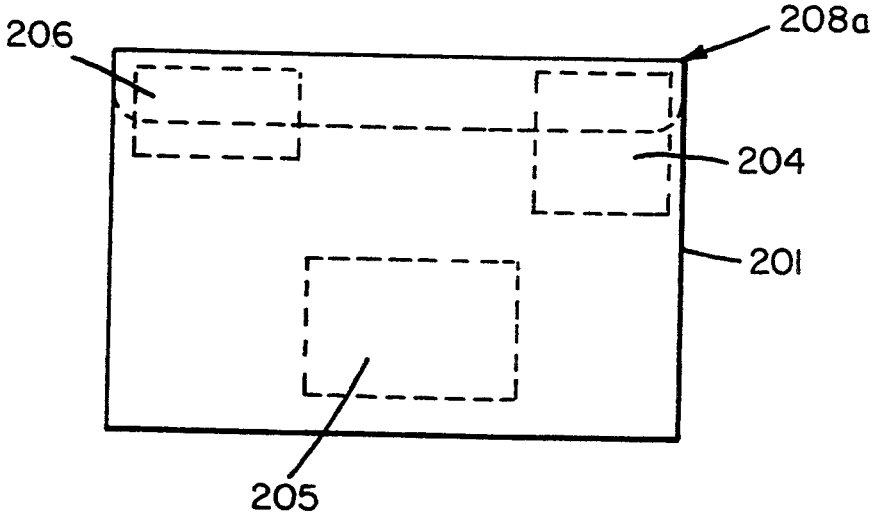
FIG. 2B is a front view of the mailing instrument shown in FIG. 2A showing the mailing instrument in a sealed position using the front fold-down flap.
Figure 2C:
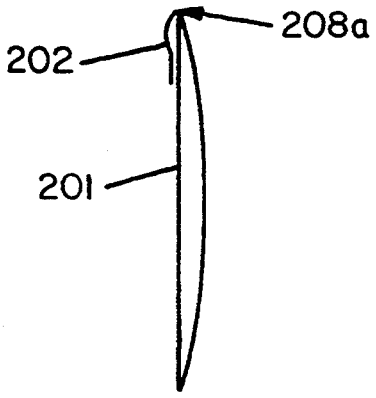
FIG. 2C is a side sectional view of the mailing instrument shown in FIG. 2B showing the arrangement of the mailing instrument body and front fold-down flap.

In a second embodiment of the invention shown in FIG. 2A the front of the mailing instrument body 201 includes on it a first postage field 204, a first addressee field 205 and a first addressor field 206. The mailing instrument body 201 is the same as the mailing instrument body 1 shown in FIG. 1A. The back fold-down flap 203 of the mailing instrument shown in FIG. 2D includes on it a second (alternative) addressor field 213, a second (alternative) addressee field 212 and a second (alternative) postage field 211. The two addressor/addressee/postage field schemes (fields 206, 205 and 204, and fields 213, 212 and 211) are provided to enable the sender to select from one of the two alternatively available addressor/addressee/postage field schemes. Examples of possible addressor information that may be used on either the first or second addressor fields are a return address, the sender's address, the recipient's address or a blank field to be filled in by the sender. Examples of possible addressee information that may be used on either the first or second addressee fields are alternative addresses for the recipient or a blank field to be filled in by the sender. Examples of possible postage fields to be used are a BRE printed postage arrangement or a blank field for placement of a conventional postage stamp on the postage field.

In the second embodiment of the invention shown in FIG. 2A it is notable that the back fold-down flap 203 is substantially the same size as the front face of the mailing instrument body 201. The rationale for having the back fold-down flap 203 substantially the same size as the front face of the body 201 is so that an alternative addressee field 212 can be provided in addition to alternative addressor and postage fields when the sender seals the mailing instrument using the back fold-down flap 203. The sealing procedure and arrangement used to secure the front fold-down flap 202 to the body 201 is the same as described above for sealing the front fold-down flap 2 to the body 1 in the preferred embodiment invention. Accordingly, the sealing procedure and arrangement used to secure the back fold-down flap 203 to the body 201 is the same as described above for sealing the back fold-down flap 3 to the body 1 in the preferred embodiment of the invention. Various views of the sealing arrangements for the front fold-down flap 202 and the back fold-down flap 203 are shown in FIGS. 2B–2E.

In the second embodiment of the invention, the sealing arrangement utilizing the front fold-down flap 202 is used when the sender selects the address and postage fields located on the front of the mailing instrument body 201. The back fold-down flap 203 is detached from the mailing instrument body 201 when the front fold-down flap 202 is used to seal the mailing instrument. Detachment of the flap 203 is made along the fold line 208*a*, facilitated by there being perforations, a crease or any other line of weakening along the fold line 208*a*. The front of the mailing instrument body 201 may have approved BRE printed postage and address information on it. The alternative sealing arrangement utilizing the back fold-down flap 203 is used when the sender selects the addressor, addressee and postage fields located on the front face of back fold-down flap 203. When the mailing instrument is sealed using the back fold-down flap 203, the front fold-down flap 202 may be detached from the body portion 201 at a line of perforations, a crease or any other line of weakening along the fold line 208. In this second embodiment the back fold-down flap 203 is of a sufficient size to cover the entire front face of the mailing instrument body 201. This embodiment of the invention proves useful in that if the back fold-down flap 203 address and postage fields are blank then the mailing instrument is convertible between a BRE sealable with the front fold-down flap 202, and a personal use envelope when the sender seals the mailing instrument with the back fold-down flap 203. The mailing instrument can then either be sent in the mail to the pre-printed addressee using business reply mail postage or to any addressee entered on the back fold-down flap using a conventional postage stamp.

In a variation of the second embodiment of the invention, shown in FIG. 2A, a portion of the back fold-down flap 203 having on it the second addressee field 212 can be removably attached to the remaining portion of the back fold-down flap 203 having on it the second addressor field 213 and the second postage field 211.

This removable attachment of the outer portion of the back fold-down flap 203 to the inner portion of the flap 203 can be achieved by perforations, a crease or an otherwise defined line of weakening in the material of the back fold-down flap 203.

Figure 5:
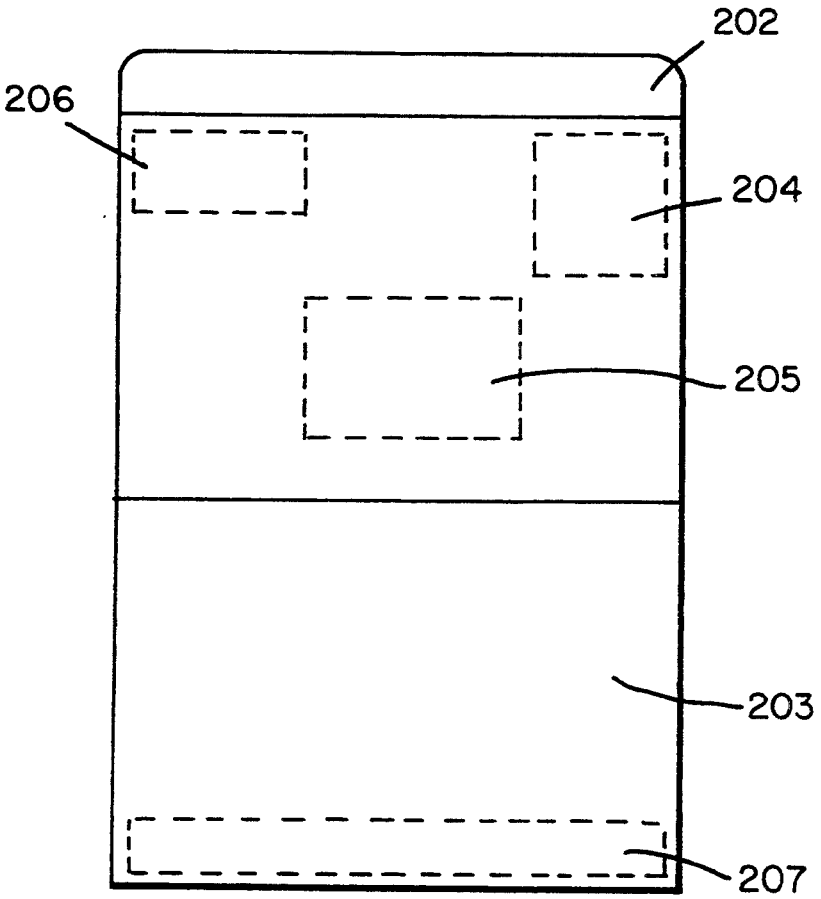
FIG. 5 is a front view of an embodiment of the invention showing a mailing instrument having two closure flaps where the closure flap having addressee, addressor and postage fields is attached at the bottom of the mailing instrument body.
Figure 6:
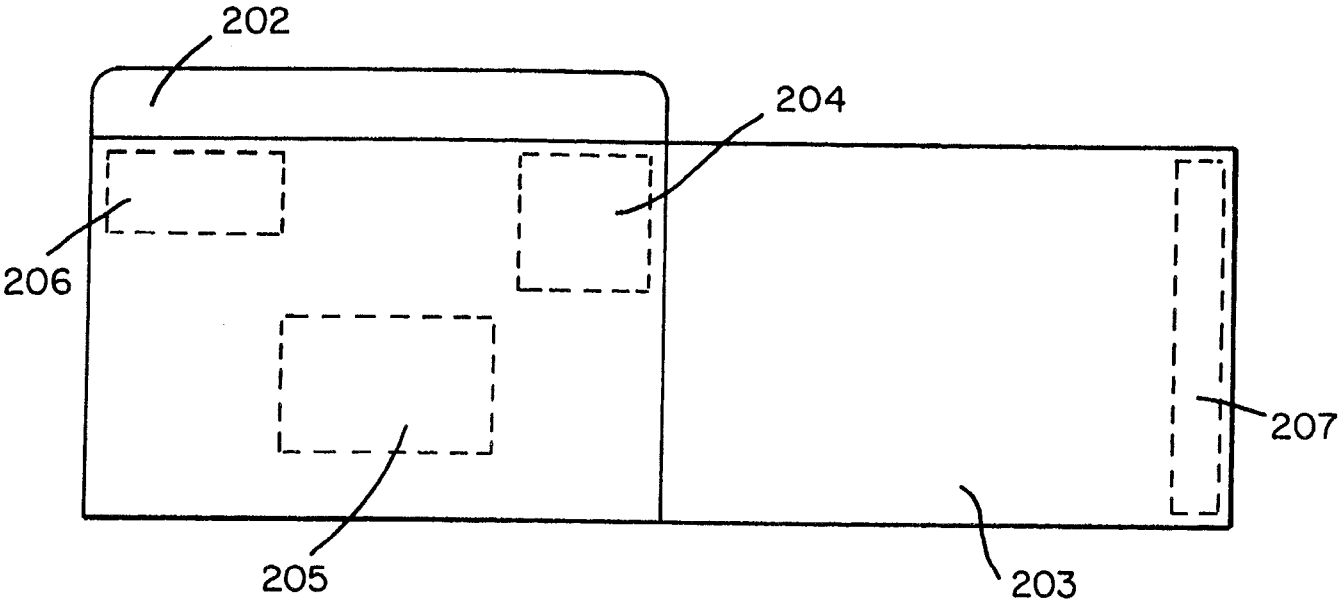
FIG. 6 is a front view of an embodiment of the invention showing a mailing instrument having two closure flaps where the closure flap having addressee, addressor and postage fields is attached at a side of the mailing instrument body.

It should be made clear that the mailing instrument instant invention as described in first and second embodiments may also be constructed with the fold-down flap (shown as 3 in FIG. 1A and as 203 in FIG. 2A) having addressee, addressor and postage fields thereon attached to the mailing instrument body at points other than at the body portion opening. For example this fold-down flap may be attached at the bottom of the mailing instrument as shown in FIG. 5 or at one side of the mailing instrument as shown in FIG. 6.

Figure 3A:
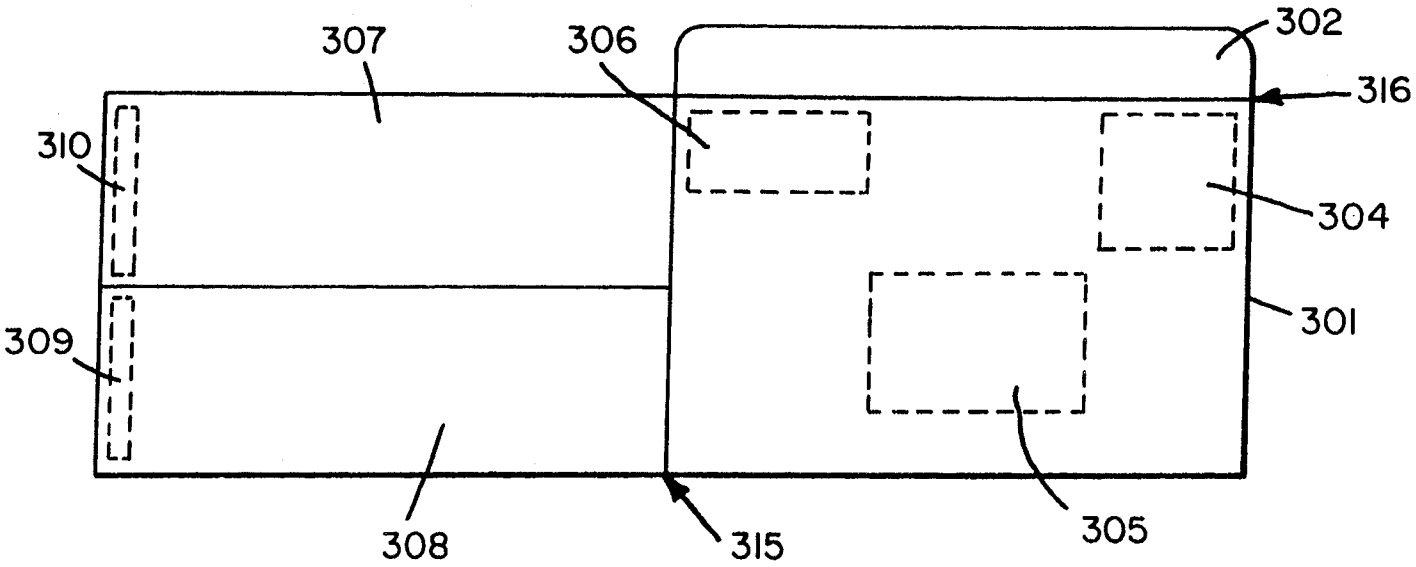
FIG. 3A is a front view of an alternative embodiment of the invention showing a mailing instrument with two side flaps providing alternative address and postage fields.
Figure 3B:
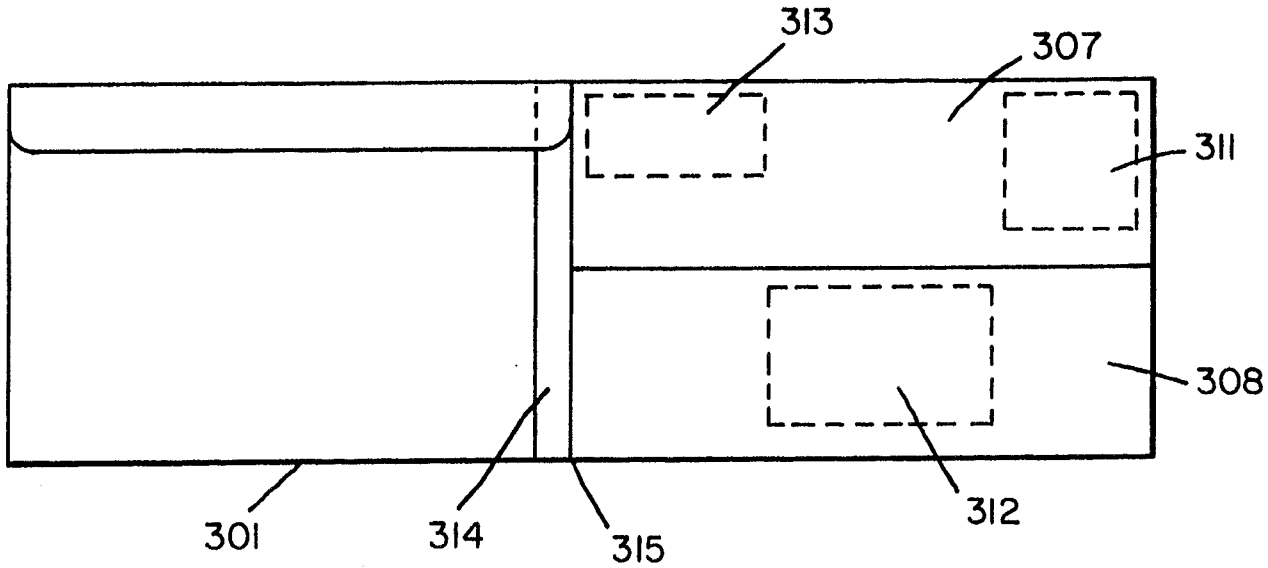
FIG. 3B is a rear view of the mailing instrument shown in FIG. 3A showing the front faces of the fold-over flaps.
Figure 3C:
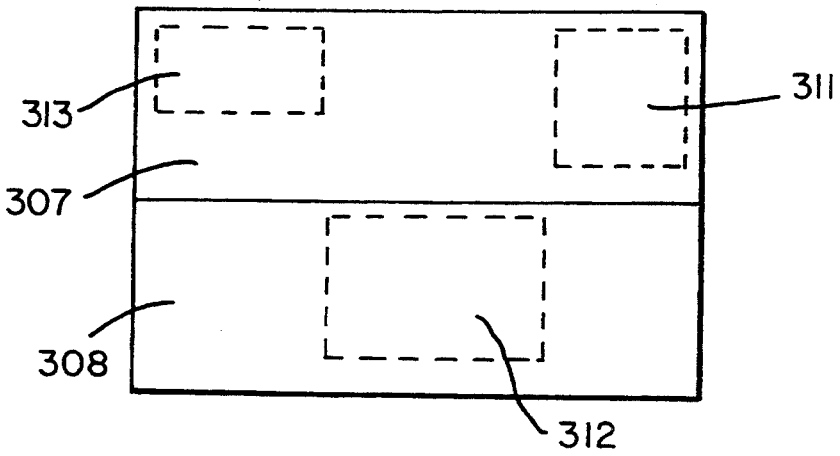
FIG. 3C is a front view of the mailing instrument shown in FIG. 3A showing the fold-over flaps in a sealed position over the front of the mailing instrument.

In a third embodiment of the invention shown in FIG. 3A an upper fold-over flap 307 and a lower fold-over flap 308 are attached to a mailing instrument body 301 by a hinge flap 314. The flaps 307 and 308 are attached to the body 301 with any adhesive applied between the hinge flap 314 and the mailing instrument body 301. The hinge flap 314 and the two fold-over flaps 307 and 308 are connected by being part of a single continuous sheet of material. The line of separation between the upper flap 307 and the lower flap 308 may be perforated, creased or an open gap extending from the outer edges of the fold-over flaps to the point where the fold-over flaps meet the hinge flap 314. A fold line 315 is defined at the common border of the hinge flap 314 and the two fold-over flaps 307 and 308. The fold line 315 may be perforated, creased or otherwise defined as a weakened line to facilitate the detachment of each of the fold-over flaps 307 and 308 from the hinge flap 314 and ultimately from the mailing instrument body 301. The mailing instrument body 301 is essentially the same as the mailing instrument body 1 shown in FIG. 1A with sole difference being that the body 301 is not attached to a back fold-down flap, instead a single flap 302 is provided at the pocket opening for closure and sealing of the body 301. The front of mailing instrument body 301 has on it a first addressor field 306, a first postage field 304 and a first addressee field 305. It should be noted that unlike the previous embodiments discussed, where the fold-down flaps served a dual purpose of sealing the mailing instrument and acting to expose or cover address and postage fields, the present fold-over flaps 307 and 308 act only to expose or cover address and postage fields and do not act to close or seal the mailing instrument pocket. The front face of the upper fold-over flap 307 has a second (alternative) addressor field 313 and a second (alternative) postage field 311, as shown in FIG. 3B depicting a rear view of the mailing instrument. The front face of the lower fold-over flap 308 has a second (alternative) addressee field 312. Flaps 307 and 308 have an adhesive material on the inside face of the outer edge of the flaps, as indicated by the areas 310 and 309 in FIG. 3A. The adhesive areas 310 and 309 are provided to enable the upper and lower fold-over flaps 307 and 308 to be sealed to the front of the mailing instrument body 301 by folding one or both of the flaps over the front face of the mailing instrument body thereby covering the address and/or postage fields on the front of the mailing instrument. The upper and lower fold-over flaps 307 and 308 are included on the mailing instrument to provide the same multiple address and postage scheme advantages achieved by employing the invention of the first two embodiments. The fold-over flaps 307 and 308 may be used individually, in tandem or detached from the mailing instrument body at the fold line 315.

By way of further detailed description the one-way multi-destination or multi-postage scheme mailing instrument, in the alternate, may be constructed by assembling a set of planar elements having variously defined fields, various terminal edges (where such planar elements are connected) and having connections by hinges and/or fold lines. Such a description follows in which the mentioned numbers refer to the drawing figures.

Construction of the body portion 1 shown in FIG. 1A is accomplished by joining two facial planes having rectangular shapes in an overlying arrangement where the rectangular shapes of the two facial planes are coextensive and have longitudinal dimensions and vertical dimensions. The longitudinal and vertical dimensions of the facial planes inherently define the terminal edges of the facial planes. The two facial planes are designated the front facial plane and the back facial plane and each has an inner and an outer planar surface. When the facial planes are placed in an overlying arrangement the inner surfaces of the two facial planes face each other. The front and back facial planes are joined along at least three (3) terminal edges to define a pocket. The two facial planes may also be made of a single continuous strip of material where the two facial planes are defined by a fold line in the continuous strip and the terminal edges of the continuous strip. In a continuous strip construction of the mailing instrument, closure along the bottom terminal edge of the body portion is provided by the fold in the continuous strip and at least two of the body portion terminal edges adjacent to the fold are joined to define a pocket with a pocket opening along the remaining body portion terminal edge(s). The thus described facial planes provide the front and back surfaces of the body portion 1. Front and back depending hinged planar elements are each joined to one of the terminal edges of each of the facial planes to provide the (previously called out) front fold-down flap 2 and the back fold-down flap 3. The front and back planar elements have terminal edges which are linear and straight. A terminal edge of the front planar element is joined to one of the terminal edges of the front facial plane and a terminal edge of the back planar element is joined to one of the terminal edges of the back facial plane. Accordingly, the front planar element (front fold-down flap 2) is hingedly joined to the front facial plane along a fold line 8 defined by the line where a front facial plane terminal edge meets a front planar element terminal edge. Similarly the back planar element (back fold-down flap 3) is hingedly joined to the back facial plane along the fold line **8*a*** defined by the line where a back facial plane terminal edge meets a back planar element terminal edge. The facial surfaces of the front and back planar elements are defined by the outer surfaces of those two elements which may contain addressee, addressor or postage fields thereon. The dorsal surfaces of the front and back planar elements are defined by the inner surfaces of those two elements which may contain adhesive fields thereon. The adhesive fields are on the planar element dorsal surfaces so that the mailing instrument or envelope is convertible to provide alternative postage or addressing schemes. Placement of the adhesive fields on the dorsal sides of the planar elements endows the inventive mailing instrument with the multiple addressing or postage scheme features. In this construction the facial surfaces of the planar elements are joined by adhesive or a hinge to the outer surfaces of each of the associated facial planes. By folding over one or the other of the planar elements so that the adhesive field on the dorsal surface of the planar element is in contact with the outer surface of one of the facial planes, the corresponding planar element facial surface is positionable to a nearly coplanar position with the facial plane outer surface with which the planar element dorsal surface is in contact. To facilitate the desirable conversion feature of the mailing instrument, a set of separable lines of definition reside between each planar element and the facial plane to which the planar element is joined to allow selective removal of the planar element at the separable line of definition.

Figure 2D:
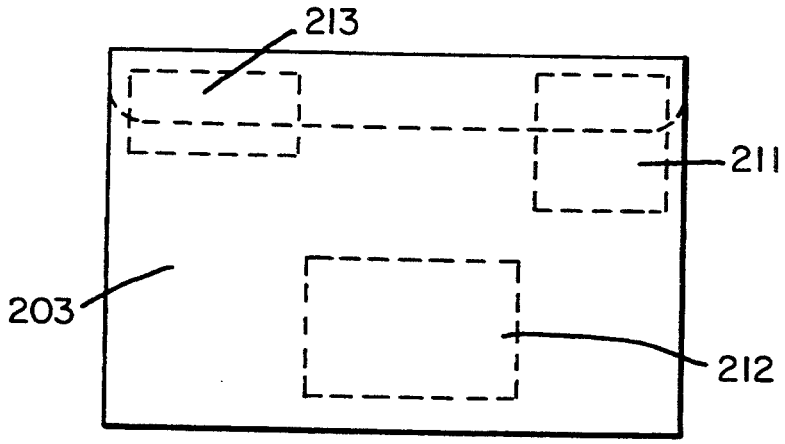
FIG. 2D is a front view of the mailing instrument shown in FIG. 2A showing the mailing instrument in a sealed position using the back fold-down flap.
Figure 2E:
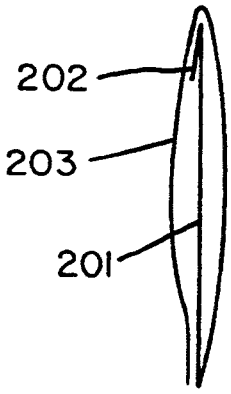
FIG. 2E is a side sectional view of the mailing instrument shown in FIG. 2D showing the arrangement of the mailing instrument body and the overlapping flaps.

With further reference to the figures, the second embodiment of the invention as shown in FIG. 2A is constructed in substantially the same fashion as described above for the first embodiment of the invention. In this second embodiment of the invention however, the back planar element (back fold down flap 203) has dimensions so as to cover the entire front facial plane. The facial surface of the back planar element shown as the back flap 203 extends from the back of the mailing instrument body 201 and provides a location for a second (alternative) addressor field 213, a second (alternative) postage field 211 and a second (alternative) addressee field 212 as shown in FIG. 2D, which allows the sender to select among at least two (2) alternative addressor/addressee/postage field schemes. The dimensions of the back planar element are selected to allow coverage of the entire front facial plane.

With further reference to the figures, the third embodiment of the invention as shown in FIG. 3A has a body portion 301 constructed in substantially the same fashion as described above for the first embodiment of the invention. In this third embodiment of the invention the back planar element is further divided into a first (upper) planar element and a second (lower) planar element which are attached collectively or independently to a side edge of one of the facial planes providing an upper fold-over flap 307 and a lower fold-over flap 308. Accordingly, the first of the two planar elements is hingedly joined along the upper side edge at a fold line 315 of either the front or the back facial plane. Similarly, the second planar element is hingedly joined along the lower side edge at the fold line 315 of either the front or the back facial plane. Facial surfaces and dorsal surfaces define the two sides of each of the planar elements. In this construction the facial surfaces of the planar elements are joined by adhesive or a hinge to the outer surface of the associated facial planes. To facilitate the desirable conversion feature of the mailing instrument, a set of separable lines of definition reside between each planar element and the associated facial plane to allow selective removal of the planar element at the separable line of definition. Adhesive fields reside on the planar element dorsal surfaces so that the mailing instrument or envelope is convertible to provide alternative postage or addressing schemes. Placement of the .adhesive fields on the dorsal sides of the planar elements endows the inventive mailing instrument with the multiple addressing or postage scheme features. In this third embodiment of the invention the first planar element (upper side fold-over flap 307) has sufficient dimensions to cover the addressor and postage fields contained on upper portion of the front facial plane. The facial surface of the first planar element shown as the upper side fold-over flap 307 extends from the side of the mailing instrument body 301 and provides a location for a second (alternative) addressor field 313 and a second (alternative) postage field 311 shown in FIG. 3B. The facial surface of the second planar element shown as the lower side fold-over flap 308 extends from the side of the mailing instrument body 301 and provides a location for a second (alternative) addressee field 312 shown in FIG. 3B. The provision of the side fold-over flaps allow the sender to select among at least two (2) alternative addressor/addressee/postage field schemes.

SUMMARY OF MAJOR ADVANTAGES OF THE INVENTION

After reading and understanding the foregoing inventive mailing instrument, in conjunction with the drawings, it will be appreciated that several distinct advantages of the subject invention are obtained.

Without attempting to set forth all of the desirable features of the instant mailing instrument, some of the major advantages of the invention include the novel configuration which allows a single mailing instrument to be used for alternative mailing purposes. Essentially, the single mailing instrument provides multiple and selectable addressing and postage fields which allow the envelope to be mailed to one of a multiplicity of shown addressees, from one of a multiplicity of shown addressors using one of a multiplicity of shown postage schemes.

The following description of the major novel features of the invention as based on the mailing instrument as shown in FIG. 2A of the second embodiment of the invention applies equally to the other described embodiments of the invention. The mailing instrument body portion 201 shown in FIG. 2A is open along the fold line 208 between the front fold-down flap 202 and the back fold-down flap 203 for reception of material to be mailed. When the user elects to use the mailing instrument with the addressing and postage fields contained on the front of the body portion, the mailing instrument is sealed with the front fold-down flap 202 after the back fold-down flap 203 is detached from the body portion. Alternatively, the user may elect to use the addressing and postage fields contained on the front face of the back fold-down flap by folding the flap forward over the front the body portion thereby covering the addressing and postage fields contained on the front of the body portion.

It should be clear that the invention as described in the various embodiments shown provides an envelope providing more than one addressee address field on the mailing instrument.

It should also be clear that the invention as described in the various embodiments shown provides an envelope providing more than one addressor field on the mailing instrument.

It should also be clear that the invention as described in the various embodiments shown provides an envelope providing more than one postage field on the mailing instrument. Specifically, the mailing instrument may provide an alternative postage field that enables the user to use the mailing instrument with a conventional postage stamp by covering printed BRE postage on the mailing instrument with a back fold-down or a side fold-over flap. Such use would avoid the registering by the Post Office of a business reply mail postage charge against the addressee.

It should also be clear that the alternative addressing and postage field selection as provided by the back fold-down flap described in the first and second embodiment is also provided by the side fold over flaps shown in FIG. 3A of the third embodiment of the invention.

Further, it should be clear that the fold-down flaps described in the first and second embodiments of the invention and the side fold-over flaps described in the third embodiment of the invention provide alternative sealing arrangements for the mailing instrument and that the contemplated mailing instrument allows for easy detachment of the fold-down and fold-over flaps.

What is claimed is:

1. A method of using a multipurpose mailing instrument, said mailing instrument including a front facial plane and a back facial plane, said back facial plane coextensive with and underlying said front facial plane; said mailing instrument further including a first planar element and a second planar element, said planar elements depending from at least one of said facial planes; said mailing instrument also including a first postal field set disposed upon one of said facial planes and a second postal field set disposed upon one of said planar elements;

said method comprising the step of manipulating said planar elements to assume a preferred mailing configuration, wherein said planar element carrying said second postal field set is detached from said mailing instrument prior to initial mailing and the other of said planar elements disposed proximate one of said facial planes in a substantially coplanar fashion therewith, thereby rendering readable said first postal field set and enabling postal delivery.

2. The method recited in claim 1 further including the step of adhesively bonding said other planar elements to one of said facial planes in a substantially permanent fashion, thereby maintaining the integrity of said preferred mailing configuration.

3. The method recited in claim 2, wherein said first planar element is linked to said front facial plane and said second planar element is linked to said back facial plane.

4. The method recited in claim 3, wherein said first postal field set is disposed upon said front facial plane and said second postal field set is disposed upon said second planar element.

5. A method of using a multipurpose mailing instrument, said mailing instrument including a front facial plane and a back facial pirate, said back facial plane coextensive with and underlying said front facial plane; a first planar element depending from one of said facial planes; a second planar element depending from one of said facial planes; a first postal field set disposed upon one of said facial planes; and a second postal field set disposed upon one of said planar elements;

said method comprising the steps of:

(1) detaching said planar element carrying said second postal field set from said mailing instrument prior to initial mailing; and, (2) locating the other said planar elements to a position which is adjacent to and substantially coplanar with one of said facial planes, thereby rendering readable said first postal field set and enabling postal delivery.

* * * * *